US006230883B1

(12) United States Patent
Colombo

(10) Patent No.: US 6,230,883 B1
(45) **Date of Patent: *May 15, 2001**

(54) MODIFIED ATMOSPHERE PACKAGING METHOD

(75) Inventor: Edward A. Colombo, Penfield, NY (US)

(73) Assignee: Tres Fresh LLC, Penfield, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/449,812

(22) Filed: Nov. 26, 1999

Related U.S. Application Data

(63) Continuation-in-part of application No. 09/182,754, filed on Oct. 29, 1998, now Pat. No. 6,023,915.
(60) Provisional application No. 60/094,694, filed on May 8, 1998.

(51) Int. Cl.[7] ..... B65D 81/20
(52) U.S. Cl. ..... 206/213.1; 426/129
(58) Field of Search ..... 206/204, 205, 206/213.1, 484, 524.8; 53/432; 426/106, 107, 118, 129

(56) References Cited

U.S. PATENT DOCUMENTS

| | | | | |
|---|---|---|---|---|
| 4,548,824 | * | 10/1985 | Mitchell et al. | 426/129 |
| 4,548,852 | * | 10/1985 | Mitchell | 426/129 |
| 5,547,694 | * | 8/1996 | Perry et al. | 426/118 |
| 5,686,126 | * | 11/1997 | Noel et al. | 426/129 |
| 6,023,915 | * | 2/2000 | Colombo | 53/432 |
| 6,042,852 | * | 3/2000 | Atwell et al. | 426/118 |

* cited by examiner

*Primary Examiner*—Jim Foster
(74) *Attorney, Agent, or Firm*—Greenwald & Basch; Howard J. Greenwald

(57) ABSTRACT

A modified atmosphere package for storing oxygen sensitive goods containing a a gas impermeable tray including flanges around the perimeter of the tray and a bottom inside surface, and a a gas impermeable film with a bottom inside surface. The film is fitted with a one-way valve and is positioned over and adjacent to the flanges of said tray, and the film is sealed to such flanges. A support extends from the bottom inside surface of the tray to the bottom inside surface of the gas impermeable film, the support being adapted to prevent the film from collapsing when the atmospheric pressure above the film exceeds the atmospheric pressure below the film.

6 Claims, 16 Drawing Sheets

MODIFIED ATMOSPHERE PACKAGING METHOD

CROSSED-REFERENCE TO RELATED PATENT APPLICATIONS

Figure 1:
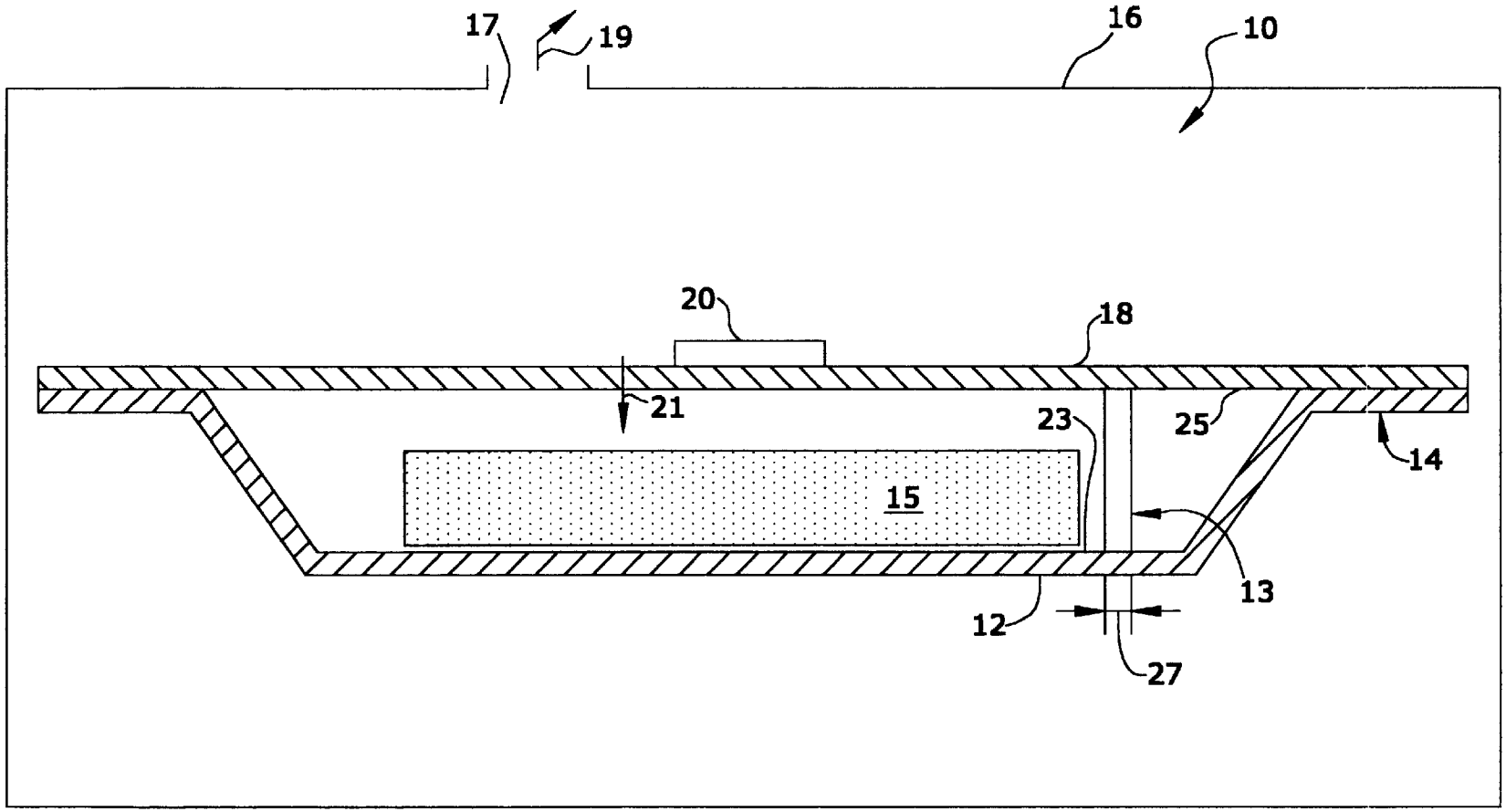

This application is a continuation-in-part of applicant's patent application U.S. Ser. No. 09/182,754, filed Oct. 29, 1998, U.S. Pat. No. 6,023,915 which relied for priority upon provisional patent application 60/094,694, filed May 8, 1998.

FIELD OF THE INVENTION

A modified atmosphere package for storing oxygen sensitive goods which contains internal means for supporting such package.

BACKGROUND INVENTION

Applicant's copending patent application U.S. Ser. No. 09/182,754 describes and claims a modified atmosphere package for storing oxygen-sensitive goods. The package of the instant application is an improvement over the package of applicant's prior case, containing means for supporting the gas impermeable film used in the package. When vacuum is applied to such package, the film often tends to collapse, causing the package to have a less desirable appearance. The package of this case is as desirable as applicant's prior package and, additionally, is not subject to being collapsed as readily by the application of vacuum.

It is an object of this invention to provide a flexible, low cost apparatus for establishing a variety of modified atmospheric conditions within a package containing a food or non-food product.

SUMMARY OF THE INVENTION

In accordance with this invention, there is provided a modified atmosphere package for storing oxygen sensitive goods, comprising: a gas impermeable tray including flanges around the perimeter of said tray, and a gas impermeable film fitted with a first one-way valve, said film positioned over and adjacent to said flanges of said tray, said film is sealed to said flanges of said try forming said package, and wherein such package contains means disposed within the package for supporting said gas impermeable film.

BRIEFED DESCRIPTION OF THE DRAWINGS

The present invention will be more fully understood by reference to the following detailed description thereof, when read in conjunction with the attached drawings, wherein like reference numerals refer to like elements, and wherein:

Each of FIGS. 1, 2, 3, 4, 5, 6, 7, 8, 9, 10, 11, 12, 13, 14, 15, and 16 is a sectional view of one embodiment of the package of this invention.

DESCRIPTION OF THE PREFERRED EMBODIMENTS

FIG. 1 is a sectional view of one preferred embodiment of the invention. Referring to FIG. 1, it will be seen that barrier film tray package 10 includes a gas impermeable tray 12 to contain oxygen sensitive food or non-food goods 15; such goods can include, e.g., meat, fish, poultry, prepared meals, non-food items, etc. A gas impermeable film or lid 18 is positioned over the goods and the tray 12.

In the embodiment depicted in FIGS. 1, 2, 3, 4, 5, 6, 7, and 8, the gas impermeable film 18 is fitted with a one-way valve 20. In the embodiment depicted in FIGS. 9, 10, 11, 12, 13, 14, 15, and 16, the one-way valve is disposed in either the bottom of gas impermeable tray 12, or on the side of gas impermeable tray 12.

Referring again to FIG. 1, and in the preferred embodiment depicted therein, the tray package 10 is disposed within a vacuum chamber 16, and vacuum is imposed through port 17 so that gas flows from the interior of chamber 16 in the direction of arrow 19. This vacuum causes valve 20 to open, allowing air within tray 12 to escape into chamber 16 and thence out of port 17.

When one ceases imposing a vacuum through port 17, the valve 20 eventually closes, thereby maintaining a vacuum within tray 12. When this occurs, the atmospheric pressure outside on top of film 18 is greater than the pressure below film 18, and film 18 will then tend to collapse in the direction of arrow 21. When this occurs, goods 15 tend to be contacted by the collapsing film 18 and/or compressed; often this collapsing film damages the goods; and, at the very least, the collapsing film tends to give the package a poor appearance.

In the embodiment depicted in FIG. 1, one or more supports 13 are disposed within the tray 12 and are contiguous with the bottom inside surface 23 of tray 12 and the top inside surface 25 of film 18.

In the embodiment depicted in FIG. 1, only one support 13 is shown for the sake of simplicity of representation. It is preferred that each tray 12 contain at least 2 of these supports 13 and, preferably, at least 3 of these supports 13. In one embodiment, tray 12 contains at least 4 of these supports 13.

The supports 13 generally have a thickness 27 of from about 0.020 to about 0.500 inches. In one embodiment, support 13 has a thickness of from about 0.1 to about 0.3 inches.

In one embodiment, the support(s) 13 are integrally connected to tray 12. In another embodiment, the support(s) 13 are adhesively connected or otherwise bonded by conventional means to the bottom surface 23 of tray 12.

In one embodiment, the support(s) 13 consist essentially of plastic material.

In one embodiment, support(s) 13 are in the form of a ring which is contiguous with but not necessarily bonded to the bottom of tray 12. Many other embodiments of support(s) 13 will be apparent to those skilled in the art; all are within the scope of this invention.

The surfaces of the flanges 14 of the tray 12 and the edges of the film 18 are sealed to prevent gases from escaping the interior of the package 10. The gas escaping the valve 20 in the film 18 can be monitored to determine when the appropriate modified atmosphere levels have been reached within the package 10. With this configuration, the need for solid carbon dioxide and/or an oxygen absorber is not required.

The package 10 can also be used in microwaveable applications, since the pressure within the package 10 is self-venting. Unlike existing food packages, the top of the package 10 does not have to be peeled back or the contents removed from the package or holes punched in the film. The package 10 can be placed directly into the microwave oven. As pressure builds inside the package 10, the one-way valve 20 on the top of the tray 12 will vent, allowing the gas to escape.

The tray 12 can be constructed of a thermoformable monolayer structure of polyester (such as amorphous poly [ethylene terephthalate]), or polyvinyl chloride. The total thickness of the material prior to thermoforming is from about 0.010 to about 0.030 inches. The tray 12 can be made of gas permeable or substantially gas impermeable materials. In one embodiment, the tray material is dense enough to prevent seepage of liquid.

One may utilize absorbent trays, such as those supplied by Vitembal (France) or Linpak (U.S./Europe). Alternatively, one may use other means, such as an absorbent pad, for absorbing liquids exuded from meat.

The tray may consist essentially of polyolefins (such as polypropylene/polyvinylidene chloride/polypropylene, with ties layers between the polypropylene and the polyvinylidene chloride), high density polyethylene, polyvinylidene chloride/high density polyethylene with tie layers between the high density polyethylene and the polyvinylidene chloride, and the like.

The tray may be constructed of a plastic foam (open celled or closed celled), such as polystyrene, polypropylene, polyvinyl chloride, and polyester; and it may include a substantially gas impermeable plastic layer laminated thereto or any combination of plastic, paper, glass, aluminum or coatings, coextrusions or laminations of such materials such that the combination contemplated provides a barrier to oxygen permeation equal to or less than 0.55 cc-mil per 100 square inches per day in ambient atmosphere at one atmosphere pressure.

In one embodiment, the laminated barrier layer is manufactured from a co-extruded LLDPE/polyvinylidene chloride/LLDPE structure with tie layers between the LLDPE and polyvinylidene layers and with a thickness of from about 0.003 to about 0.006 inches. Alternatively, the tray may be constructed of a polyamide (such as nylon), a coextruded nylon/EVOH structure laminated to a LLDPE or LLDPE/LPDE heat sealable layer with tie layers between the nylon and EVOH layers, said structure being commercially available from Allied Specialty Films in the United States.

Figure 2:
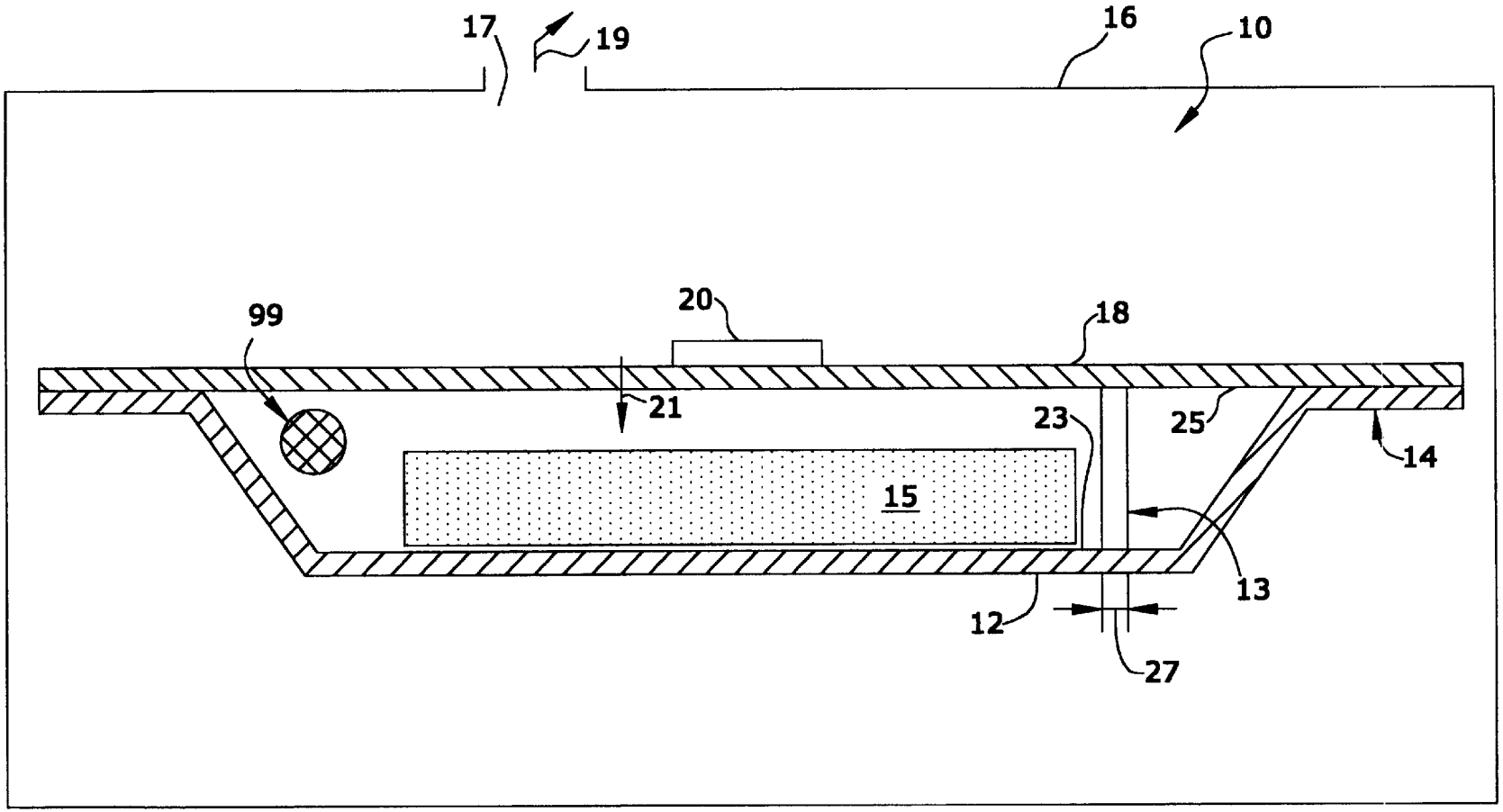

FIG. 2 is a sectional view of a tray package 10 which is comprised of solid carbon dioxide 99. In general, from about 10 to about 150 grams of carbon dioxide 99 is present, generally at a temperature of less than about −60 degrees Fahrenheit.

It is preferred that the solid carbon dioxide not be contiguous with the oxygen-sensitive goods 15 but, instead, be contiguous with tray 12.

As will be apparent to those skilled in the art, as air is removed through valve 20 upon the imposition of vacuum through port 17, the solid carbon dioxide sublimes and fills the tray 12 with gaseous carbon dioxide. The sublimation generally is slower than the evacuation; and, thus, the support 13 is essential for preventing the film 18 from collapsing.

In one embodiment, air is evacuated from tray 12 at a rate of at least about 0.1 liters per second when the vacuum is imposed through port 17.

Figure 3:
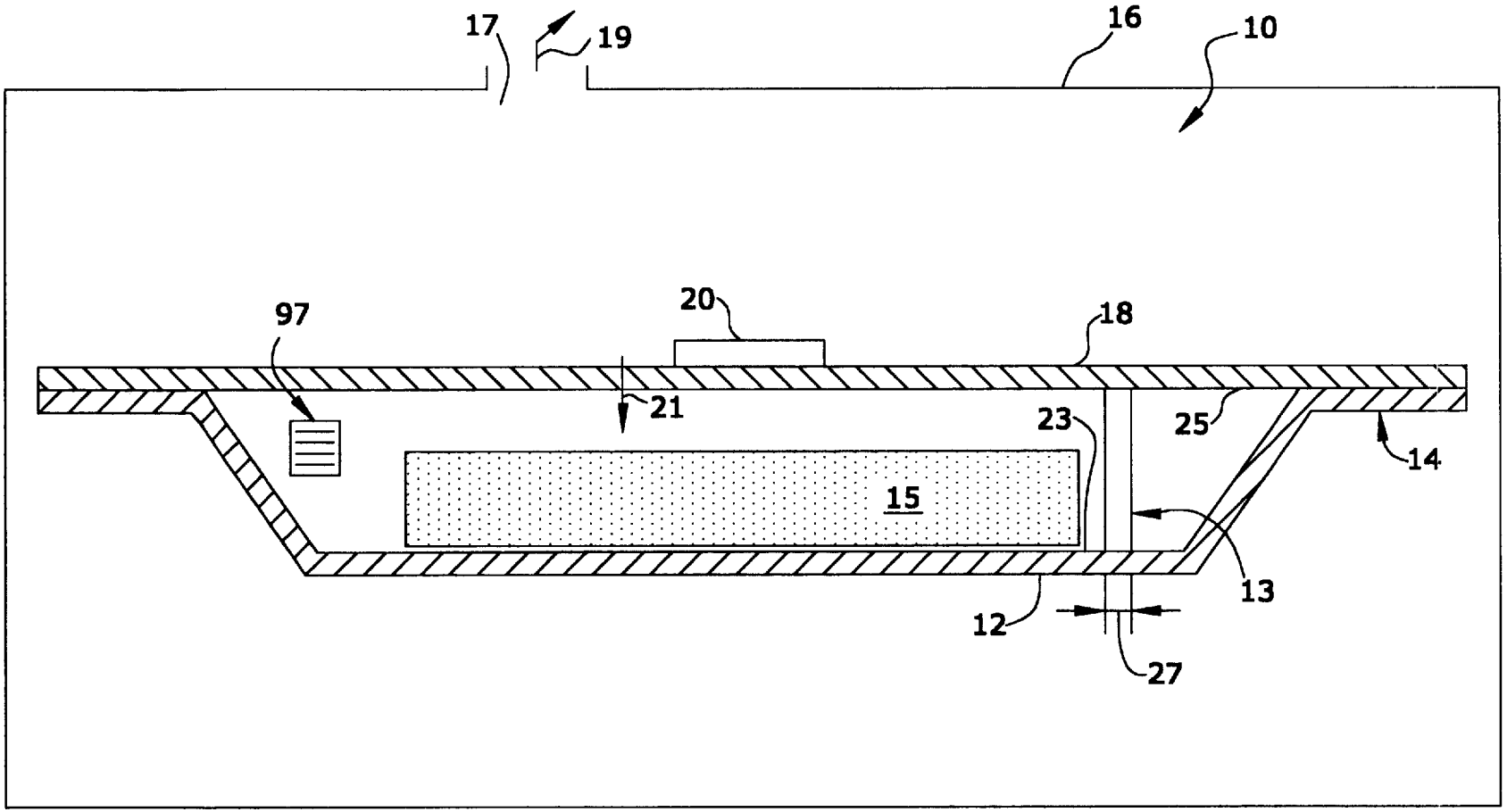

In the embodiment illustrated in FIG. 3, instead of using solid carbon dioxide within tray 12 (see FIG. 2), an oxygen-absorber 97 is used. These oxygen absorbers are well known to those skilled in the art. Thus, for example, in U.S. Pat. No. 5,698,250 of Gary R. DelDuca et al., which is assigned to Tenneco Packaging Inc., a "modified atmospheric package" was claimed. This package contained ". . . an oxygen scavenger activated with an activating agent . . . ." According to the patentees, the oxygen scavenger is necessary because "Low-level oxygen systems relying upon evacuation techniques to diminish oxygen levels suffer from several disadvantages . . . the evacuation techniques render it difficult to remove any oxygen within a previously wrapped package such as an overwrapped meat tray . . . . The trapped oxygen raises the residual oxygen level in the package and can also cause billowing and subsequent damage to the package during evacuation" (see lines 3–15 of column 2 of this patent). The entire disclosure of this patent is hereby incorporated by reference into this specification. Furthermore, each of the prior art references cited during the prosecution of this patent are also hereby incorporated by reference into this specification.

Figure 4:
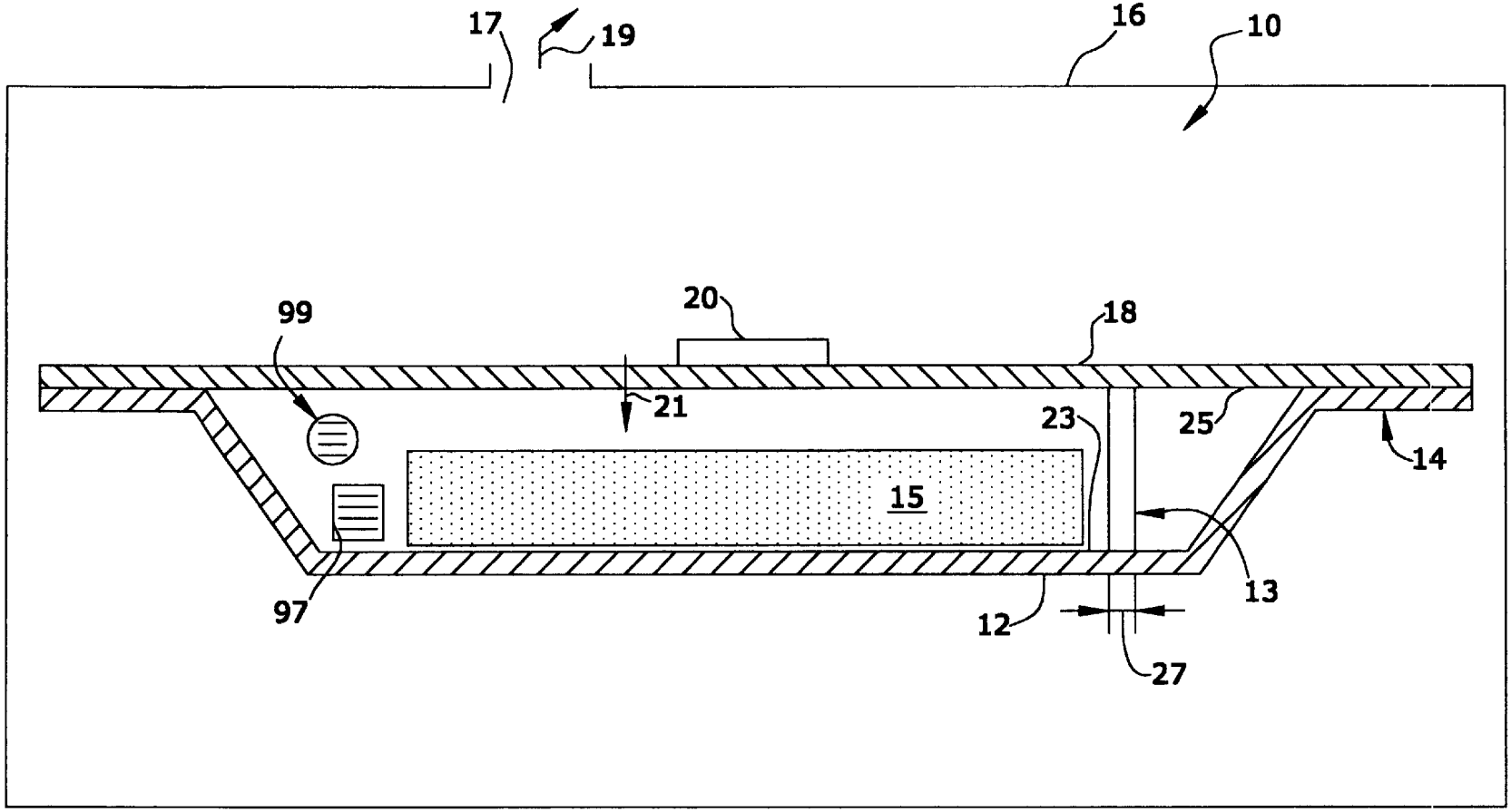

FIG. 4 is a sectional view of a package 10 which contains both an oxygen-absorber 97 and solid carbon dioxide 99.

Figure 5:
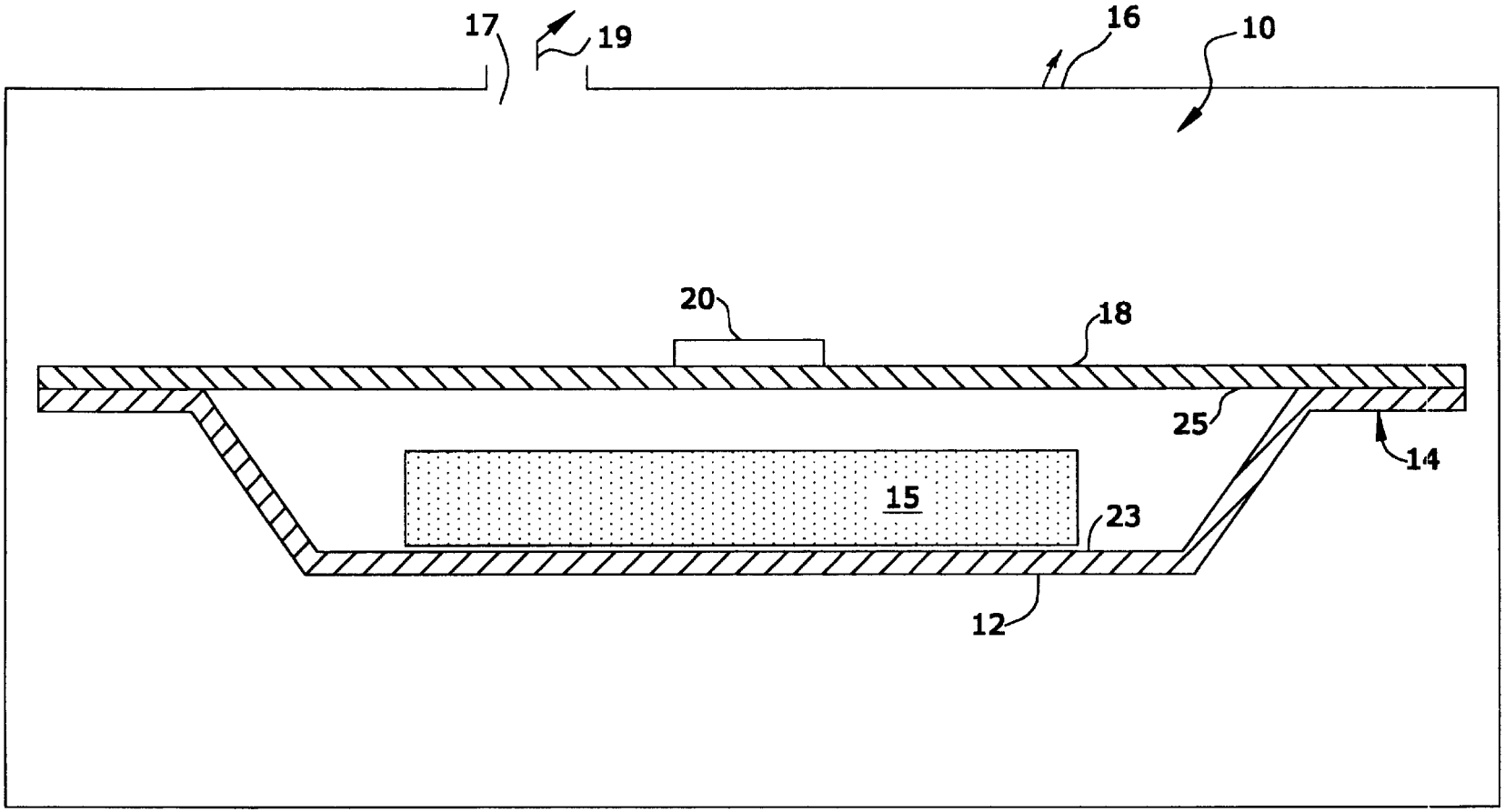

FIG. 5 illstratews an embodiment with neither the oxygen-absorber 97 or the solid carbon dioxide 99, and with only one valve 20.

Figure 6:
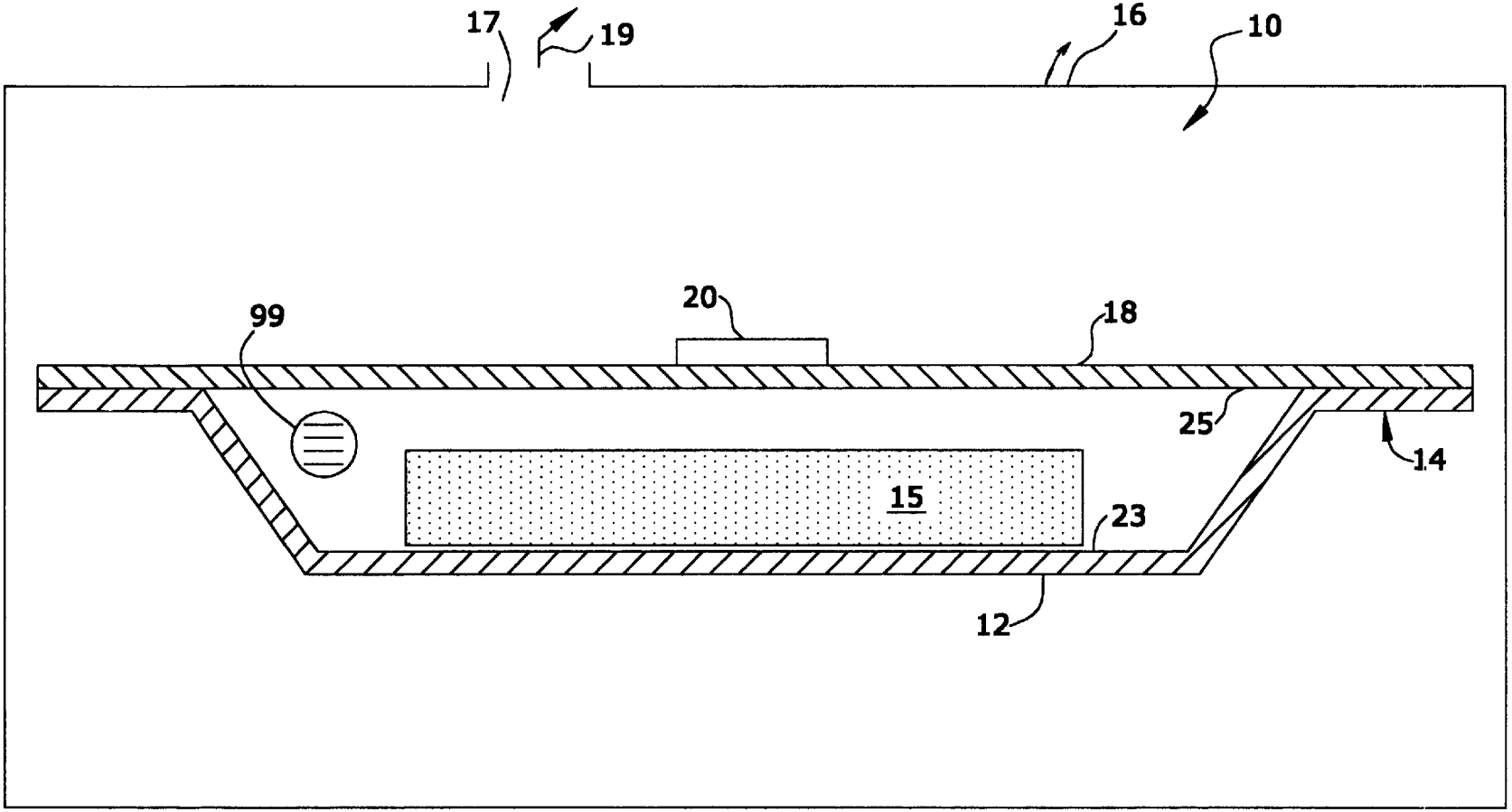
Figure 7:
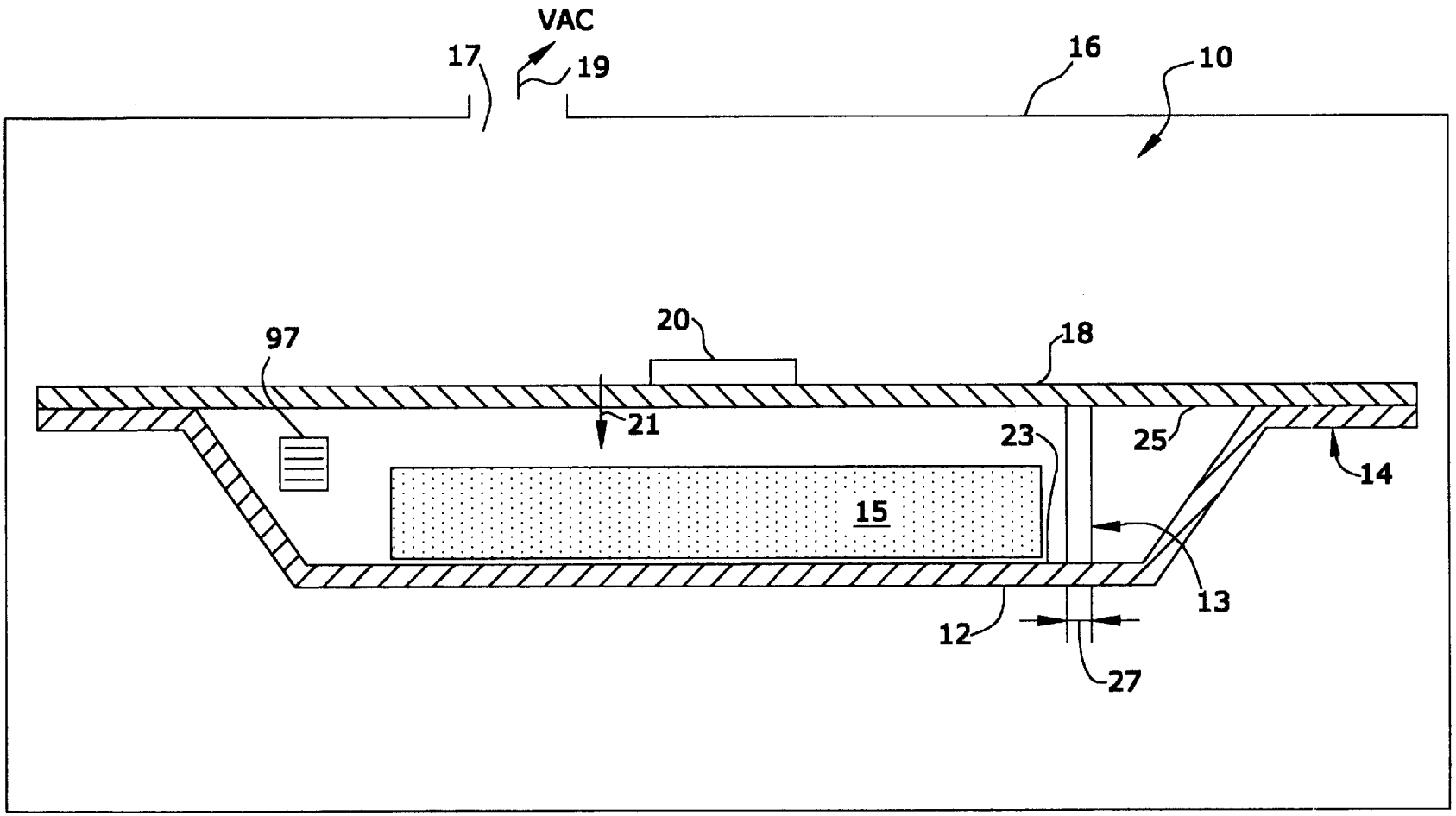
Figure 8:
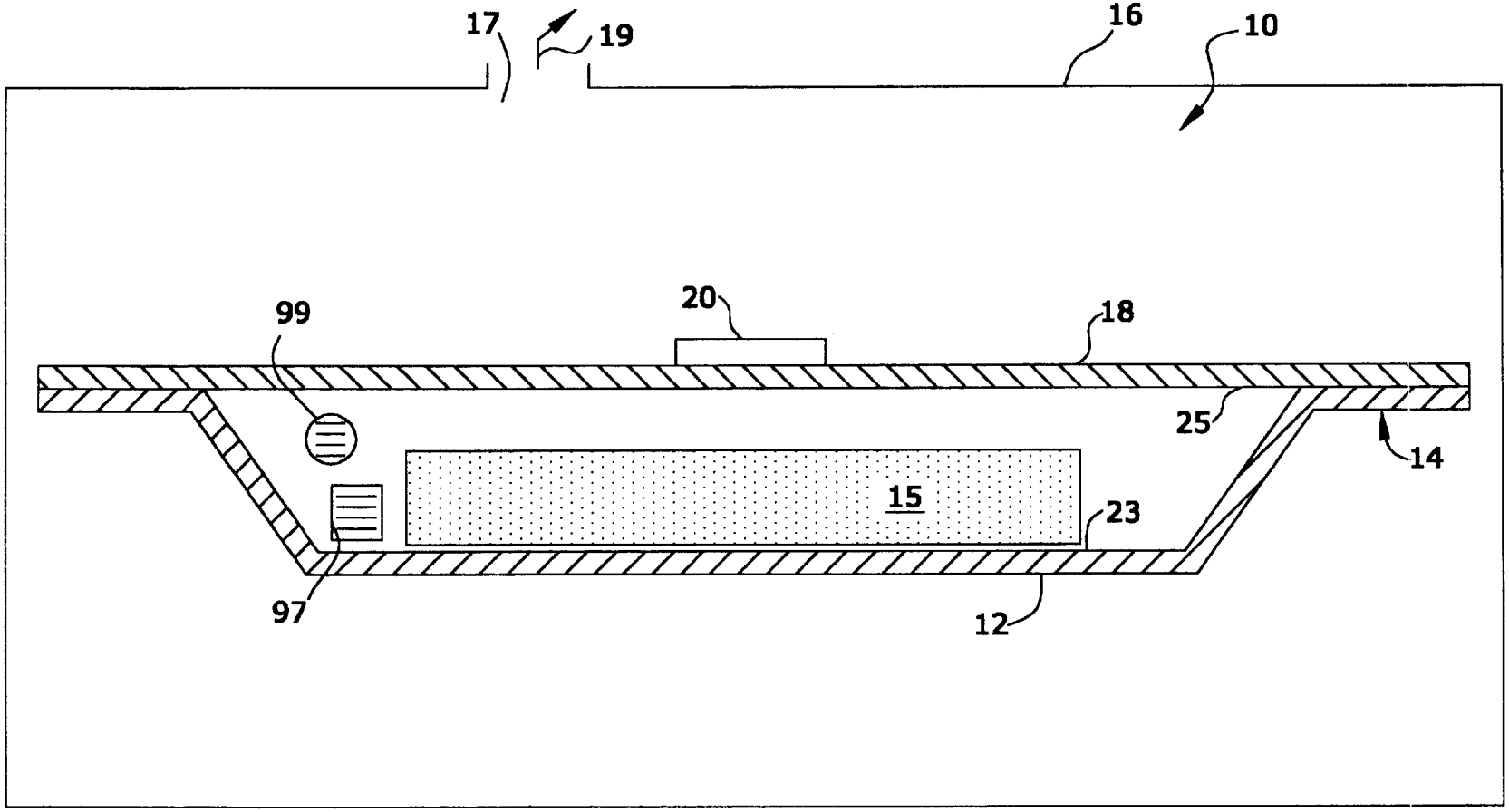

FIG. 6 illustrates a tray 10 similar to that depicted in FIG. 5 but which contains solid carbon dioxide 99. FIG. 7 illustrates a tray 10 similar to that depicted in FIG. 5 but which also contains oxygen scavenger 97. FIG. 8 illustrates a tray 10 similar to that depicted in FIG. 8, but which also contains solid carbon dioxide 99.

Figure 9:
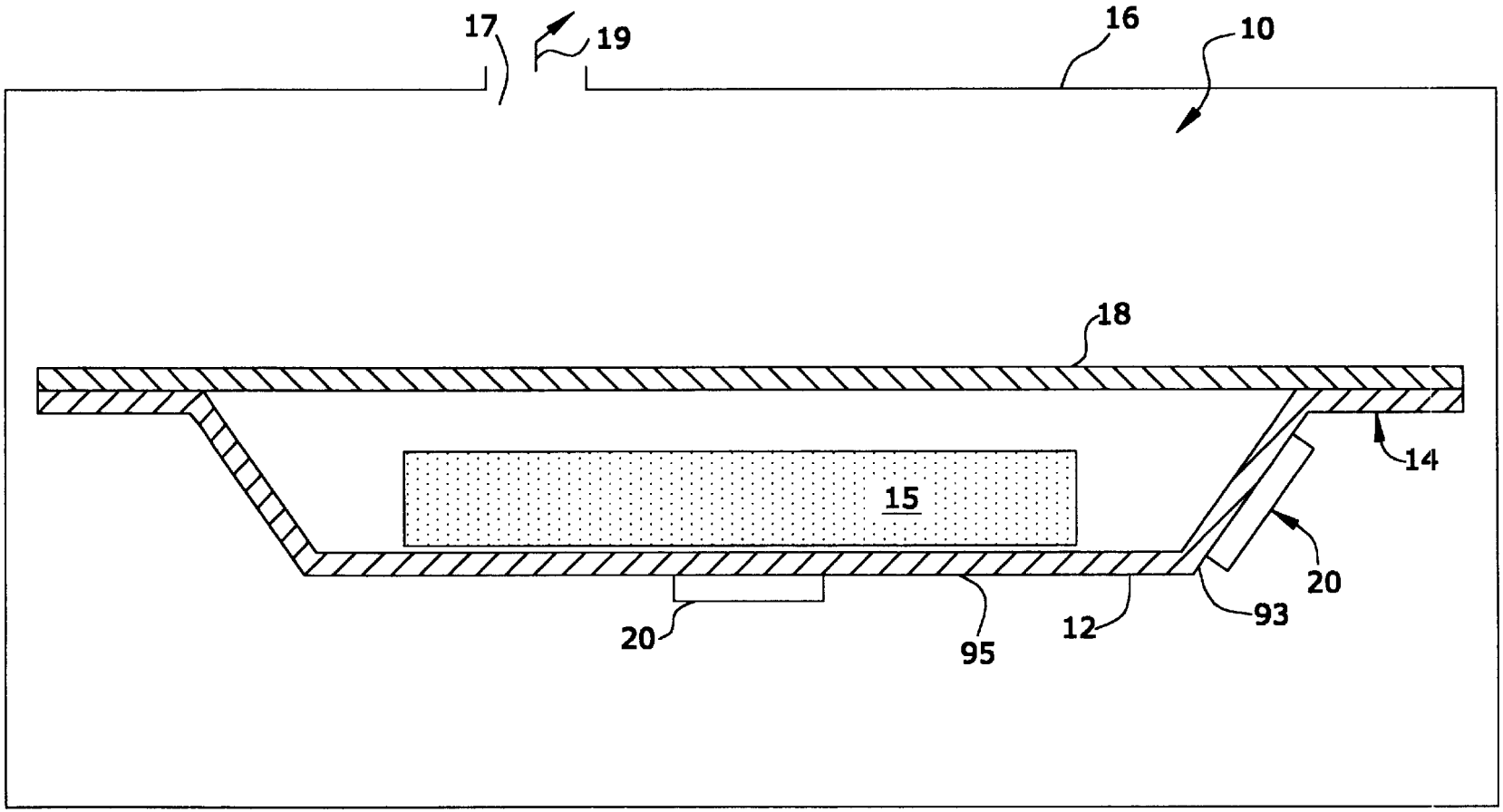
Figure 10:
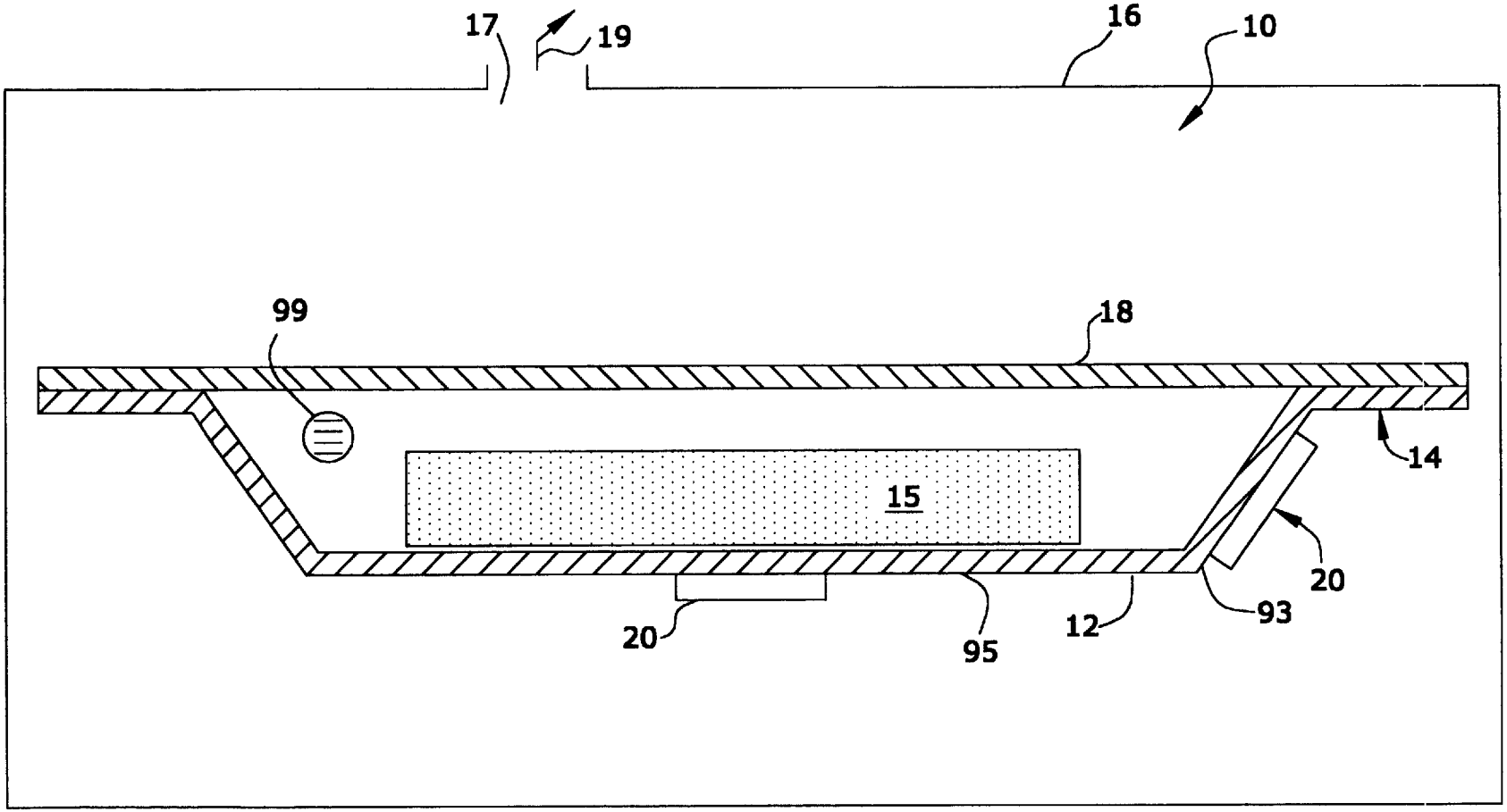
Figure 11:
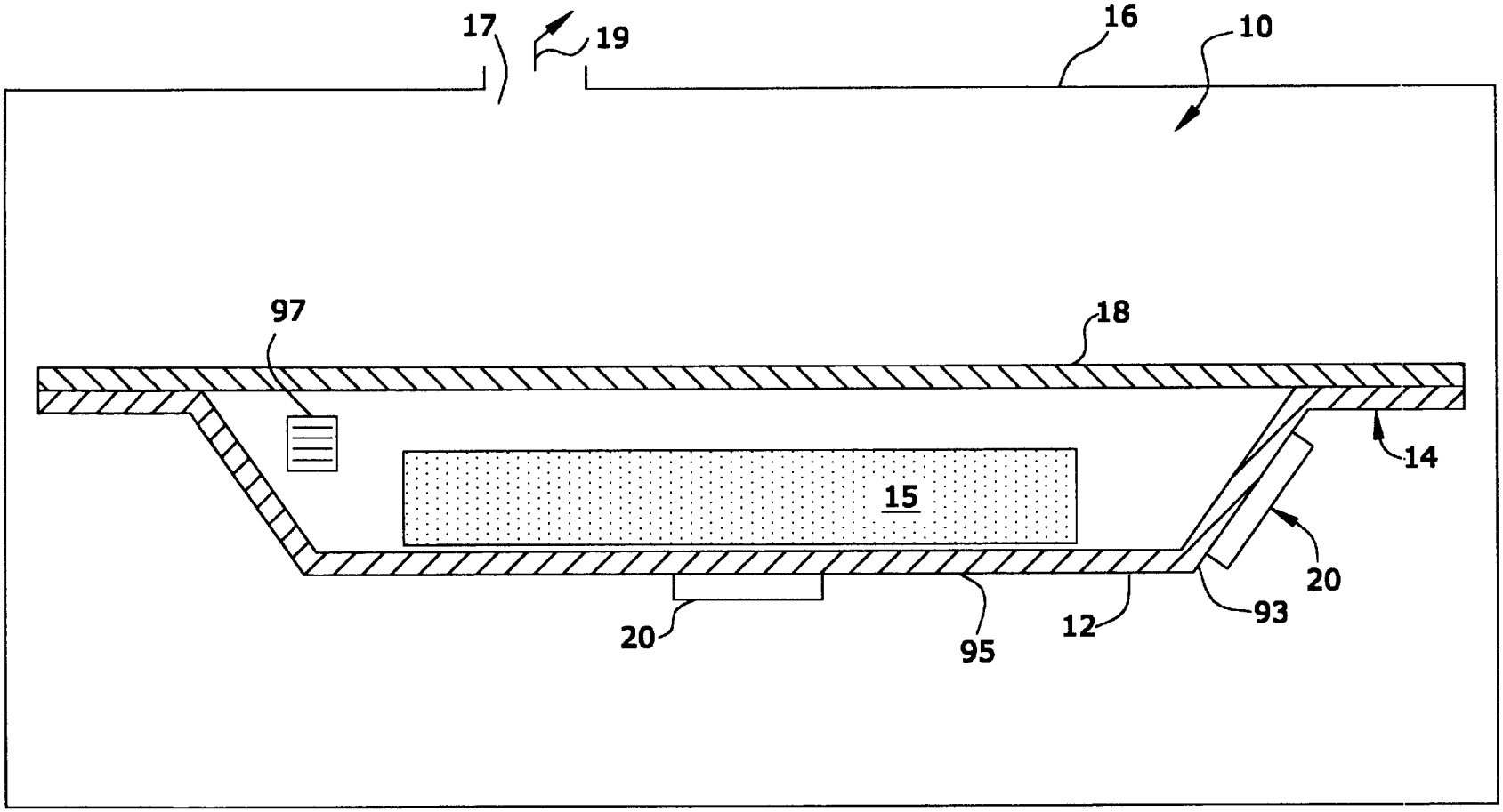
Figure 12:
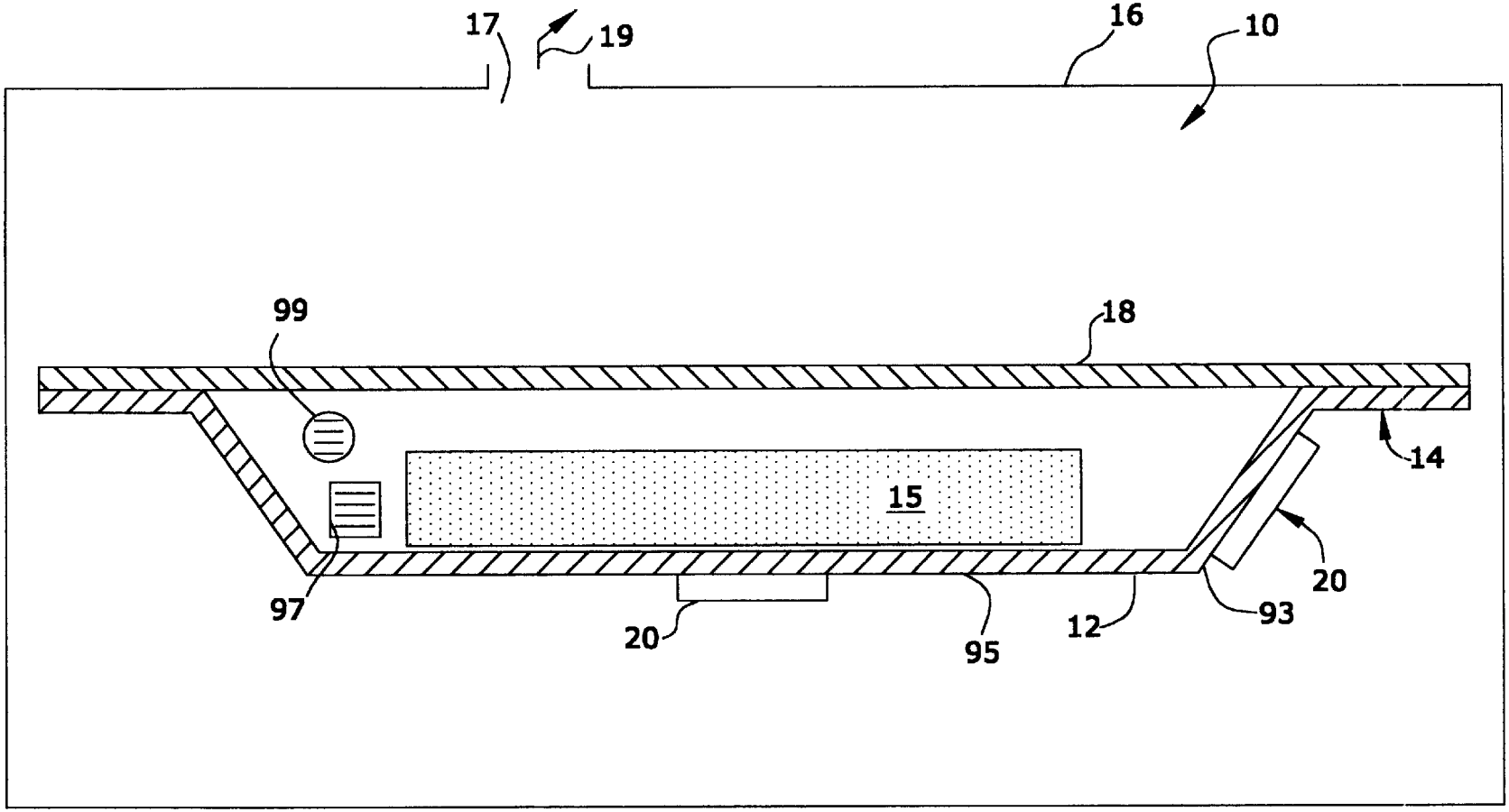

FIG. 9 illustrates a tray assembly 10 with a valve 20 located either in the bottom 95 of the tray assembly or in the sidewall 93 of the tray assembly. In this embodiment, only one valve 20 is preferably used, in either of the designated locations. FIG. 10 illustrates a tray assembly 10 similar to that illustrated in FIG. 9 but which also contains solid carbon dioxide 99. FIG. 11 illustrates a tray assembly similar to that illustrated in FIG. 9 but which also contains an oxygen-scavenger 97. FIG. 12 illustrates a tray assembly similar to that depicted in FIG. 10 but which also contains an oxygen-scavenger 97.

Figure 13:
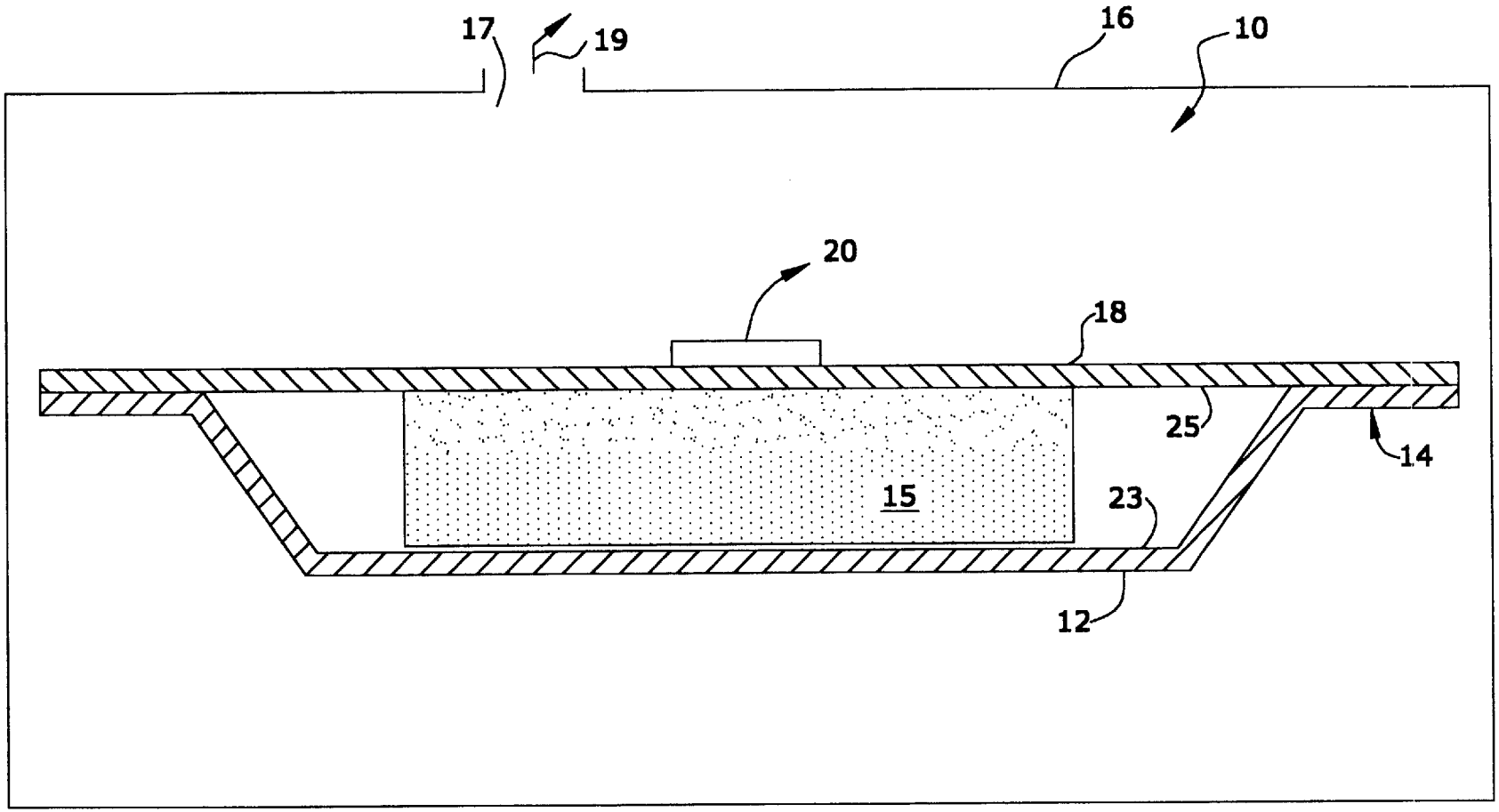
Figure 14:
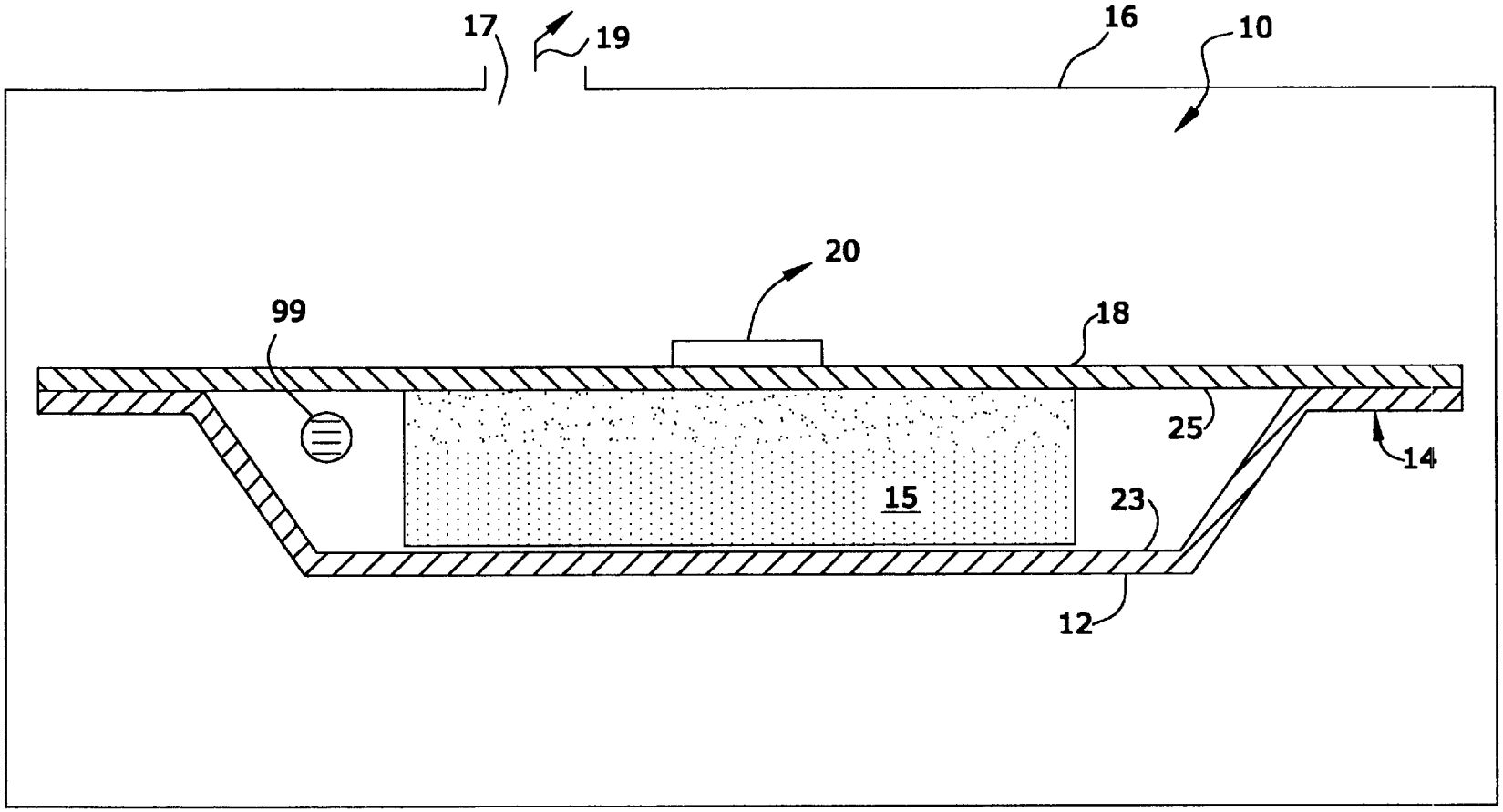
Figure 15:
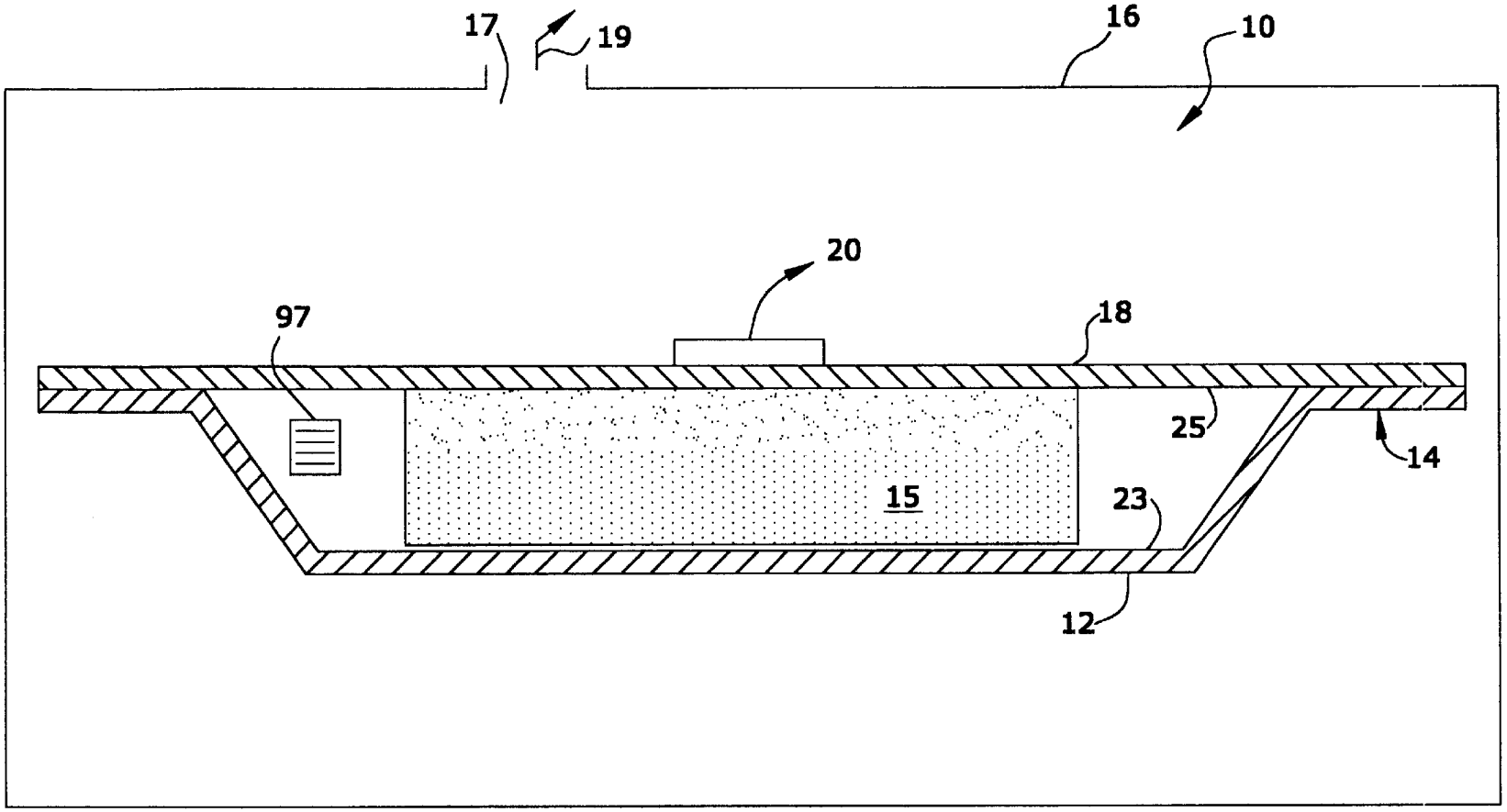
Figure 16:
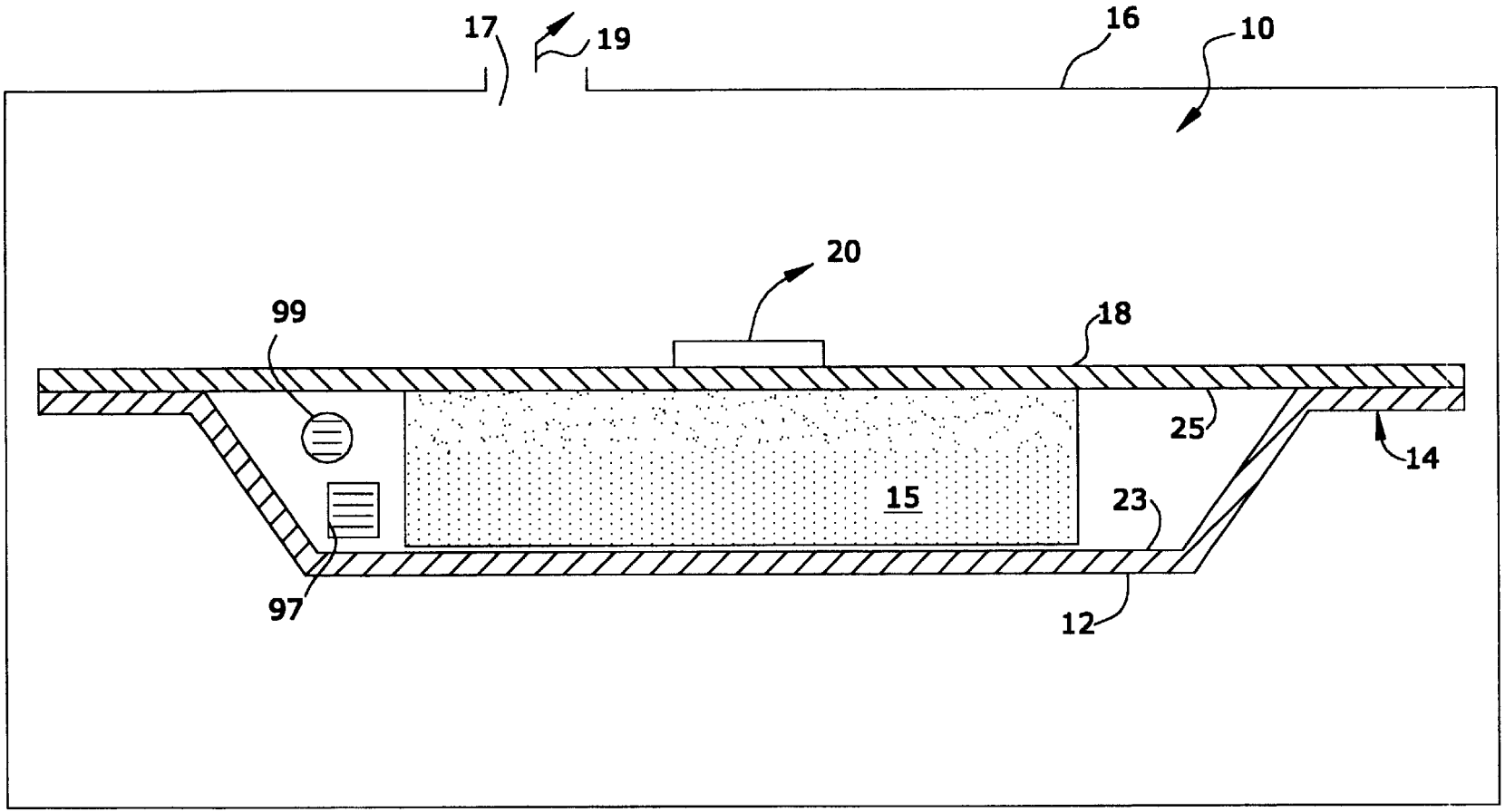

FIG. 13 illustrates a tray assembly 10 in which the perishable goods 15 are contiguous with both the bottom 23 of tray12 as well as the bottom surface 25 of film 18. As will be apparent to those skilled in the art, in this embodiment the oxygen-sensitive goods 15 acts as a support in place of support 13 (see FIG. 1). FIG. 14 illustrates a tray assembly similar to that depicted in FIG. 13 but which also contains solid carbon dioxide 99. FIG. 15 illustrates a tray assembly 10 similar to that depicted in FIG. 13 but which also contains oxygen scavenger 97. FIG. 16 illustrates a tray assembly similar to that depicted in FIG. 14 but which also contains an oxygen scavenger 97.

The one-way valve 20 may be, e.g., the one-way valve produced by Plitek LLC of Des Plaines, Ill.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. A modified atmosphere package for storing oxygen sensitive goods, comprising:

a gas impermeable tray including flanges around the perimeter of said tray and a bottom inside surface;

a gas impermeable film with a bottom inside surface, wherein said film is fitted with a one-way valve, and said film is positioned over and adjacent to said flanges of said tray, and said film is sealed to said flanges of said tray to form said package, and a support extending from said bottom inside surface of said tray to said bottom inside surface of said gas impermeable film, said support being adapted to prevent said film from collapsing when the atmospheric pressure above said film exceeds the atmospheric pressure below said film, wherein from about 10 to about 150 grams of solid carbon dioxide are present in said tray.

2. The modified atmosphere package as recited in claim 1, wherein said tray is comprised of oxygen-sensitive goods.

3. The modified atmosphere package as recited in claim 2, wherein said solid carbon dioxide is not contiguous with said oxygen-sensitive goods.

4. A modified atmosphere package for storing oxygen sensitive goods, comprising:

a gas impermeable tray including flanges around the perimeter of said tray and a bottom inside surface; and a gas impermeable film with a bottom inside surface, wherein said film is fitted with a one-way valve, and said film is positioned over and adjacent to said flanges of said tray, and said film is sealed to said flanges of said tray to form said package, and a support extending from said bottom inside surface of said tray to said bottom inside surface of said gas impermeable film, said support being adapted to prevent said film from collapsing when the atmospheric pressure above said film exceeds the atmospheric pressure below said film, wherein said modified atmosphere package is comprised of an oxygen scavenger, wherein from about 10 to about 150 grams of solid carbon dioxide is present in said tray, and wherein said solid carbon dioxide is at a temperature of less than about −60 degrees Fahrenheit.

5. The modified atmosphere package as recited in claim 4, wherein said tray is comprised of oxygen-sensitive goods.

6. The modified atmosphere package as recited in claim 5, wherein said solid carbon dioxide is not contiguous with said oxygen-sensitive goods.

* * * * *